US008220116B2

(12) United States Patent
Schwab

(10) Patent No.: US 8,220,116 B2
(45) Date of Patent: Jul. 17, 2012

(54) SELF-LOCKING CONNECTING DEVICE

(75) Inventor: Francis Schwab, Courtételle (CH)

(73) Assignee: Francis Schwab, Courtételle (CH)

( * ) Notice: Subject to any disclaimer, the term of this patent is extended or adjusted under 35 U.S.C. 154(b) by 941 days.

(21) Appl. No.: 11/886,963

(22) PCT Filed: Mar. 23, 2006

(86) PCT No.: PCT/CH2006/000173
§ 371 (c)(1),
(2), (4) Date: Sep. 24, 2007

(87) PCT Pub. No.: WO2006/102778
PCT Pub. Date: Oct. 5, 2006

(65) Prior Publication Data

US 2009/0049664 A1 Feb. 26, 2009

(30) Foreign Application Priority Data

Mar. 31, 2005 (CH) ..... 0564/05

(51) Int. Cl.
*A44B 17/00* (2006.01)

(52) U.S. Cl. ..... 24/572.1; 24/574.1

(58) Field of Classification Search ..... 24/604, 24/458, 464, 465, 470, 472–475, 453, 574.1, 24/580.1, 581.1, 614, 615, 629; 411/446, 411/447, 508
See application file for complete search history.

(56) References Cited

U.S. PATENT DOCUMENTS

| | | | | | |
|---|---|---|---|---|---|
| 646,667 | A | * | 4/1900 | McDonald | 24/41.1 |
| 1,169,693 | A | * | 1/1916 | Swedlund | 24/574.1 |
| 1,504,761 | A | | 8/1924 | Hubbell | |
| 1,827,309 | A | * | 10/1931 | Dyresen | 24/687 |
| 1,870,061 | A | * | 8/1932 | Mitchell | 24/686 |
| 2,121,524 | A | * | 6/1938 | Kimbell | 292/288 |
| 2,937,834 | A | * | 5/1960 | Orenick et al. | 248/71 |
| 4,218,599 | A | * | 8/1980 | Garn | 200/530 |
| 4,566,159 | A | | 1/1986 | Leroux | |
| 4,716,633 | A | * | 1/1988 | Rizo | 24/453 |
| 4,777,704 | A | * | 10/1988 | Acker | 24/106 |
| 4,934,885 | A | * | 6/1990 | Woods et al. | 411/44 |
| 5,155,893 | A | | 10/1992 | Nussberger et al. | |
| 6,634,693 | B2 | * | 10/2003 | Straesser, Jr. | 296/70 |
| 7,001,128 | B2 | * | 2/2006 | Kuntze | 411/508 |

(Continued)

FOREIGN PATENT DOCUMENTS

DE 202004005412 U1 7/2004

(Continued)

OTHER PUBLICATIONS

European Office Action in corresponding European application No. 06705413.0; issued Nov. 24, 2008; 3 pages.

(Continued)

*Primary Examiner* — Robert J Sandy
*Assistant Examiner* — Rowland D Do
(74) *Attorney, Agent, or Firm* — Foley & Lardner LLP

(57) ABSTRACT

A connecting device including three elements, namely: a core which is housed in an inner part and an outer part. The core includes a head having a truncated-cone-shaped part and a rod having, for example, one of the two sides of a collar connected thereto, the other side being connected to the outer part. The inner part is snap engaged in the outer part and is simultaneously detached from the core. The head is shaped such that, in a closed configuration, the head inhibits the engagement element such that the device locks when the rod is pulled.

9 Claims, 7 Drawing Sheets

U.S. PATENT DOCUMENTS

| | | | | |
|---|---|---|---|---|
| 7,213,597 | B2 * | 5/2007 | Huttner | 128/869 |
| 7,640,639 | B2 * | 1/2010 | de Bien | 24/615 |
| 2006/0112525 | A1 * | 6/2006 | Castellote | 24/453 |

FOREIGN PATENT DOCUMENTS

| | | | |
|---|---|---|---|
| FR | 2531322 | | 2/1984 |
| FR | 2611452 | | 9/1988 |
| FR | 2694485 | | 2/1994 |
| GB | 16559 | A | 4/1916 |
| JP | 58128519 | A | 8/1983 |

OTHER PUBLICATIONS

English translations of Japanese Office Action in corresponding Japanese application No. 2008-503343; issued Sep. 9, 2011; 2 pages.

* cited by examiner

SELF-LOCKING CONNECTING DEVICE

BACKGROUND (1) Field of Embodiments

The present invention refers to a self-locking connecting device according to the preamble of independent claim 1.

The privileged fields of application of this kind of device are jewelry and clockmaking.

(2) Description of Related Art

The basic problem that is encountered is the perfect safety of the connection and the reliability of the latter, combined, first of all, with a simple, quick, and comfortable operation of the device, furthermore with a rational and subtle construction of the latter that allows a manufacture at minimum cost and a genuine polyvalence both in its applications and in its usage, and ultimately, more particularly if it is intended for use in jewelry or clockmaking, with a sober, discrete, and attractive esthetic, which implies a harmonic shape and overall dimensions that are reduced to the minimum.

The types of connecting devices known in the art are quite numerous. However, they are still affected by more or less marked drawbacks with regard to all or part of this problem.

Among the best known connecting devices, commonly called clasps, the spring ring clasp may be cited, which is formed of a hollow ring that is cut on a segment and of a pin that can be operated to open or close that segment and has the same curvature as the latter, which pin is under the action of a spring accommodated in the ring. The latter is attached to one end of a necklace. The loop of a chain link or of another ring connected to the second end of the necklace can be inserted therein through the open segment while the pin that closes the ring is moved against the action of the spring. The pin is then released, thereby reclosing the ring. This system is thought to be inelegant as it is ill adapted to the shape of the necklace, bulky, and heavy. Moreover, it often requires an additional safety.

Moreover, when the clasp is fastened to a short necklace, it is located behind the neck of the person wearing it. In order to manipulate the clasp of the necklace, the person has to operate blindly and his or her arms are in a tiring position. If the person fails to insert the two elements of the clasp into each other right away, successive trials and fumbling will be the result. This uncomfortable manipulation may lead to an incomplete lock, and the clasp may sometimes be undone by accident.

FR-A-2 694 485 discloses a locking device comprising a body with two pivoting elements and a male end portion whose shape corresponds to that of a recess in a housing of the body. When the male end portion is introduced into the recess of the body, a key can be pivoted and placed in a receptacle of the end portion. A cover ensures the closure by preventing an involuntary retraction of the key.

FR-A-2 531 322 describes a clasp for a necklace chain that comprises two pieces sliding one in the other, namely an outer sleeve provided with a slot for introducing an end link of the chain and an inner slide element provided in its upper part with a notch for receiving the link. This clasp further comprises a locking tooth that is connected to the slide element and is engaged in an aperture of the slide element in the locking position.

However, these clasps do not offer an acceptable solution to the aforementioned drawbacks.

FR-A-2 611 452 discloses a clasp composed of a male part and a female part which cooperate with each other by the implementation of a snap function. This clasp provides an improvement in that it seems to offer a satisfactory closure safety and to allow quite an easy operation by feel. In contrast, the opening operation is very uncomfortable, the production, i.e. the manufacture of the clasp is delicate and costly, and its esthetic is all but fortunate.

SUMMARY

The present invention aims to provide a global rather than a partial solution to the problem laid out in the introduction, in the sense that it meets each one of the aspects of this problem.

This is accomplished by the means defined in the characterizing part of independent claim 1, the dependent claims relating to preferred means of realization of the invention.

Thus, the closure, for example of a piece of jewelry such as a necklace, is safe and reliable. Opening and closure are achieved in a comfortable, simple, and quick manner. The device is esthetically perfect due to its general shape that may advantageously be cylindrical or prismatic, and its size is minimal. Finally, the manufacturing costs of its component parts are reduced to minimum on account of their simple shapes.

This series of advantages is completed by that of polyvalence both in its application and in its usage since through its concept, the device of the invention may be used—to cite only some examples among a multitude of others—e.g. for the attachment of an USB key, a mobile telephone, a pen, a key ring, a decorative element, of a leash to a necklace for a pet or other attachments of the kind, a hook to the end of a fishing line, in each case in the adapted dimensions which may range from the smallest to the largest. It will be noted in this context that the device, or more precisely one element of the latter, may be integrated in the object to be connected itself or used for fastening interchangeable elements of the object, e.g. a pendant.

BRIEF DESCRIPTION OF THE DRAWINGS

Now, by way of non-limiting examples, two embodiments of the connecting device according to the invention will be described with reference to the attached drawing, in which.

DETAILED DESCRIPTION

Figure 1:
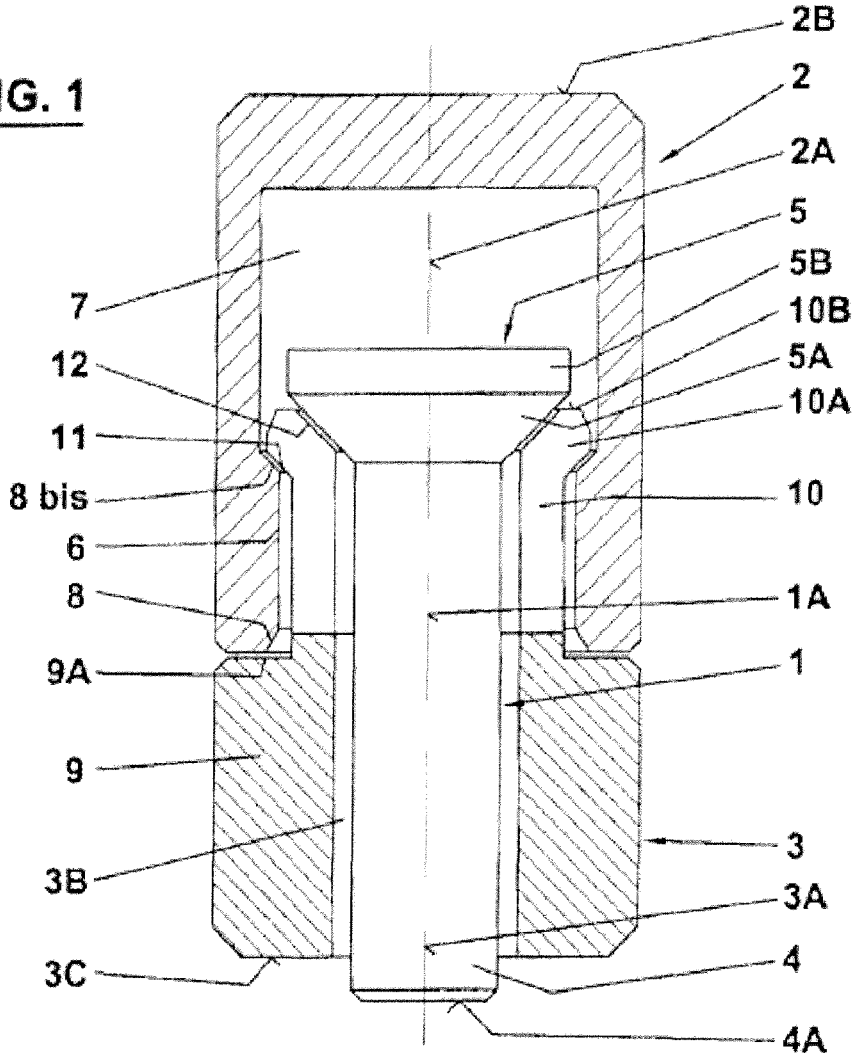
FIG. 1 is an axial section of the device according to a first embodiment in the assembled, i.e. closed state.

It is seen in FIG. 1 that the self-locking connecting device, hereinafter called clasp by convention, comprises three main parts, namely a female part 2, a male part 3 and an auxiliary part or core 1.

In the first embodiment illustrated here, core 1 with axis 1A is composed of a cylindrical stem 4 having a lower surface 4A and of a head 5 formed of a frustoconical portion 5A whose large diameter is heightened by a base 5B.

Female part 2 with axis 2A is a cap particularly the upper surface 2B of which may be provided with attachment points or eyelets. An inner recess results from a cylindrical bore 6 whose diameter is defined so as to be able to form a guide for male part 3 (see below), this bore 6 opening onto a cylindrical bore 7, whose diameter is larger than the diameter of bore 6, via a frustoconical ramp 8bis. The lower side of bore 6 opens toward the exterior via a ramp 8 that is analogous to ramp 8bis, whose respective roles will be discussed below.

Figure 2:
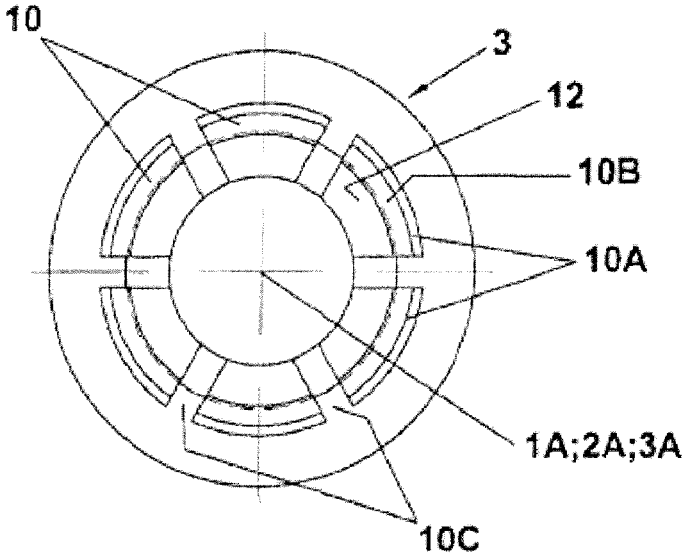
FIG. 2 is a top view of the male part of the device.

Male part 3 with axis 3A is a collet or sleeve having an internal bore 3B that extends from side to side and opens in a conical shape 12 (on the upper side). This collet has a lower portion 9 (whose lower radial surface is referenced by 3C) that is followed by an upper portion 10, thus forming a shoulder 9A. This upper portion has at least two longitudinal slits 10C (see also FIG. 2) which terminate at the height of said shoulder 9A approximately. The planes of symmetry (not shown) of each one of the slits comprise axis 3A, so as to form at least two fingers that are elastically deformable and dimensioned accordingly. For an application in jewelry, the number of slits, and consequently of fingers, is advantageously four. However, this number may be greater, for example equal to six, as shown in FIG. 2 (the single reference 10 being used to designate the entire tubular part provided with slits or one or another of the fingers). The ends of fingers 10 open to form each a part of a corolla 10A having frustoconical external and internal surfaces 11 and 12, respectively (aforementioned conical opening shape), and an upper crown 10B (reference numeral 10A may also designate the corolla as a whole).

Core 1 extends inside male part 3 and projects therefrom, on its upper side, by base 5B essentially and, on its lower side, by a (non-referenced) portion of stem 4, while it is observed that in alternative embodiments, stem 4 may be dimensioned such that its lower surface 4A is flush or approximately flush with the lower surface 3C of part 3, or even recessed from the latter. Frustoconical portion 5A of head 5 is partly facing frustoconical surface 12 of corolla 10A, whereas frustoconical surface 11 of the corolla is partly facing ramp 8bis of female part 2.

Starting from the clasp in the assembled, i.e. closed state as illustrated in FIG. 1, its operation will now be described while it is first observed that female part 2 is e.g. connected to one of the ends of a necklace while the other end of the necklace is connected to stem 4 of core 1, which can slide inside female part 2 within the limits of a clearance that may be provided, i.e. of a space between the upper (non-referenced) surface of head 5 and the (non-referenced) surface of female part 2 located opposite the head.

Figure 3:
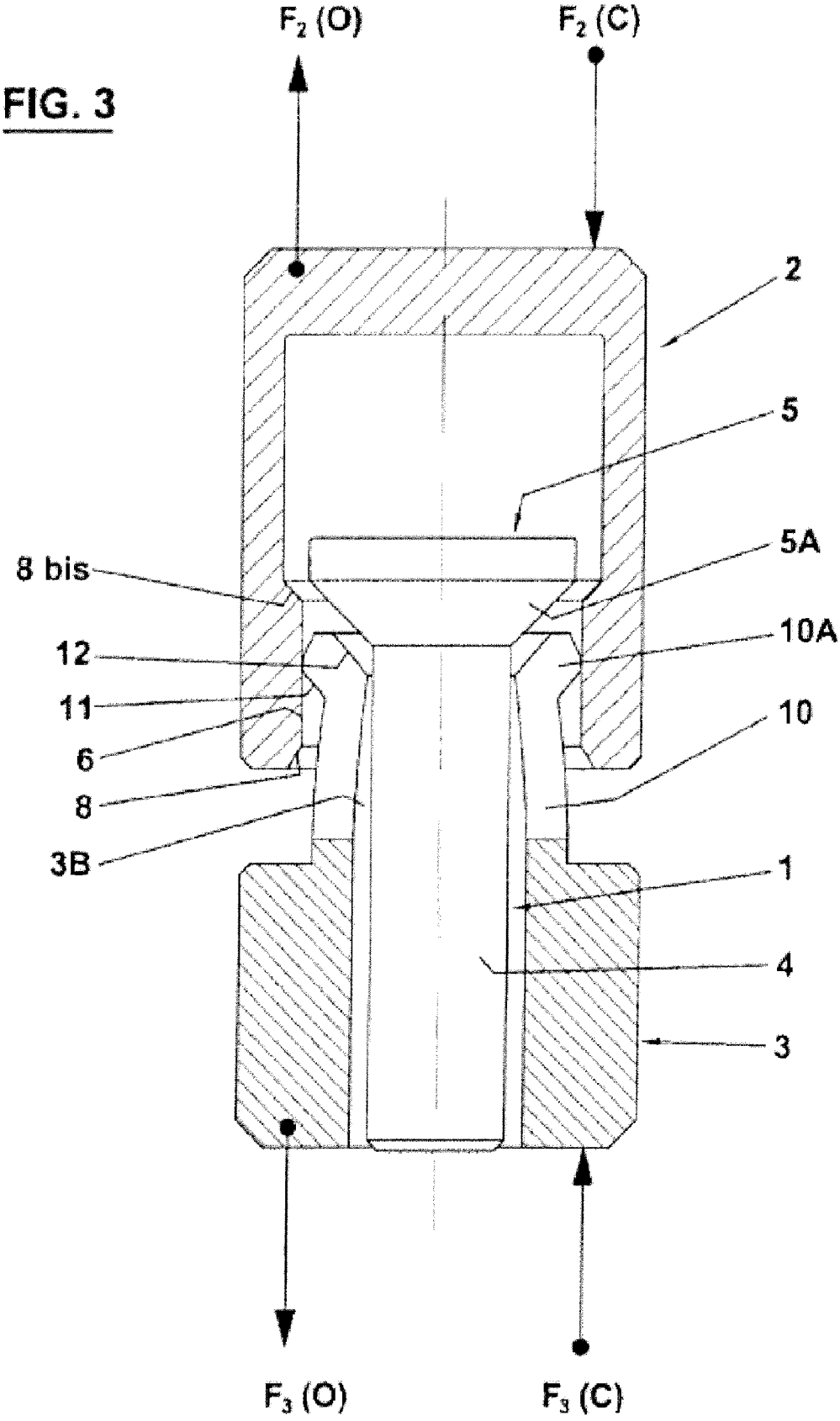
FIG. 3 is an axial section of the device in an intermediate state (during its opening or closure)

Referring to FIG. 3, it is understood that the clasp is opened by an axial traction $F_3(O)$ applied to male part 3 while female part 2 is being maintained in place, i.e. concomitantly subjected to a contrary reaction force $F_2(O)$. In a first phase (which stage is not graphically represented), corolla 10A is clamped between head 5 of core 1 and ramp 8bis of female part 2, frustoconical surface 5A bearing on frustoconical surface 12 and frustoconical surface 11 bearing on ramp 8bis. In a second phase, fingers 10 are elastically bent under the effect of the radial components of the aforementioned forces, surface 11 sliding on ramp 8bis. In a third phase, the most peripheral surface or edge (not referenced) of corolla 10A slides along bore 6 while being guided by the latter, while the edge (not referenced) formed between bore 3B and frustoconical surface 12 of corolla 10A uniformly approaches the envelope of stem 4 (position as shown in FIG. 3) or may even contact the latter slightly.

Figure 4:
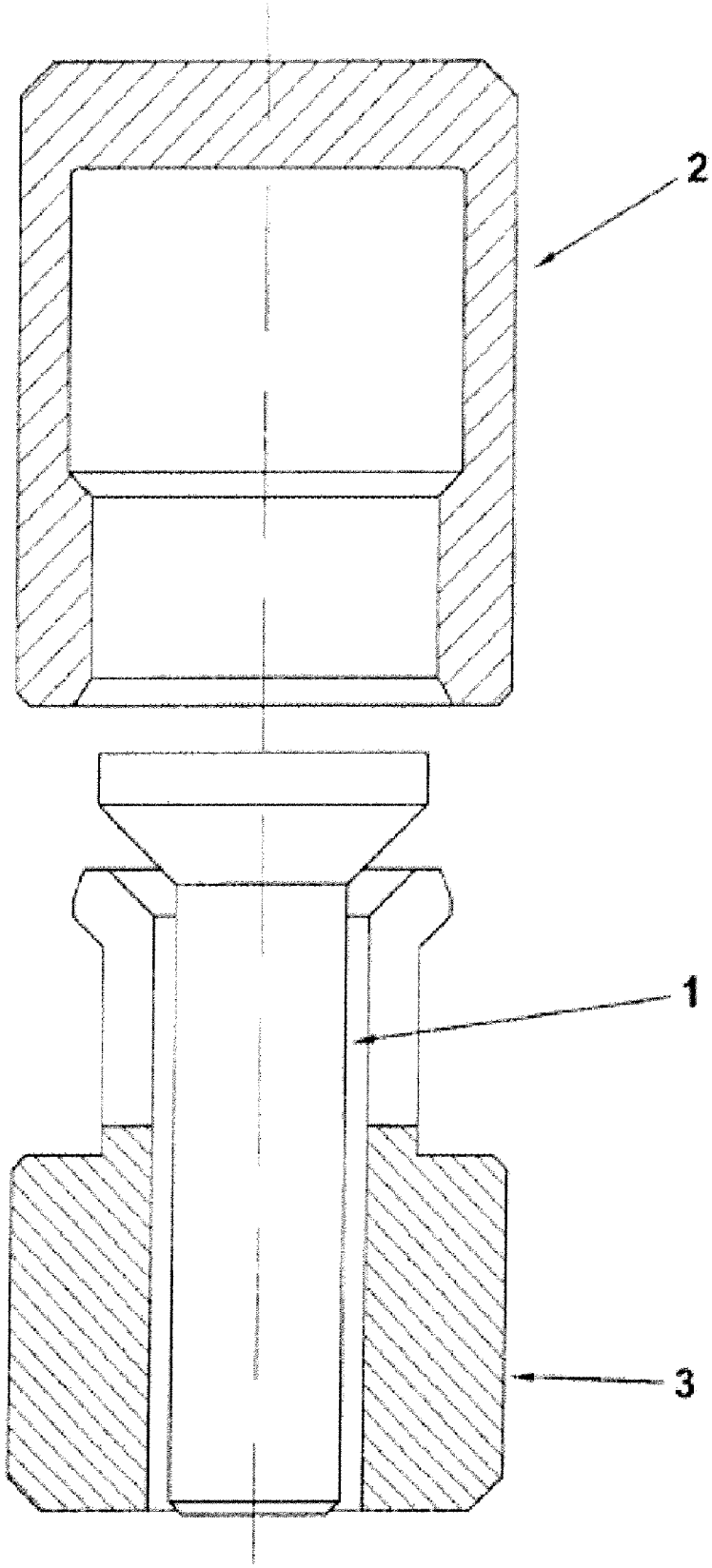
FIG. 4 is an axial section of the device in the open state.

As they arrive at the height of ramp 8, corolla 10A and hence fingers 10 progressively open to return to their initial positions when the assembly of the two parts 1 and 3 is extracted from female part 2 (FIG. 4).

The closure (in order to connect, in the example, the two ends of the necklace) is obtained by snap action upon performing the inverse operations of those carried out in the opening operation and that have just been described, an axial pressure force $F_3(C)$ being applied to male part 3 with core 1 while female part 2 is retained, i.e. concomitantly subjected to a contrary reaction force $F_2$ (C) (see FIG. 3). In a first phase, corolla 10A bearing on ramp 8 has the effect of contracting fingers 10 until they reach the position shown in FIG. 3. Then, the axial movement of part 3, along with part 1, along bore 6 continues, corolla 10A progressively opening from the moment it arrives at the height of ramp 8bis until fingers 10 reach the final closure position as shown in FIG. 1.

It is understood that all elements of the clasp are dimensioned such that the operations of snapping in and releasing the parts (parts 1 and 3, on one hand, and part 2, on the other hand) can be performed efficiently and without wedging.

Figure 5:
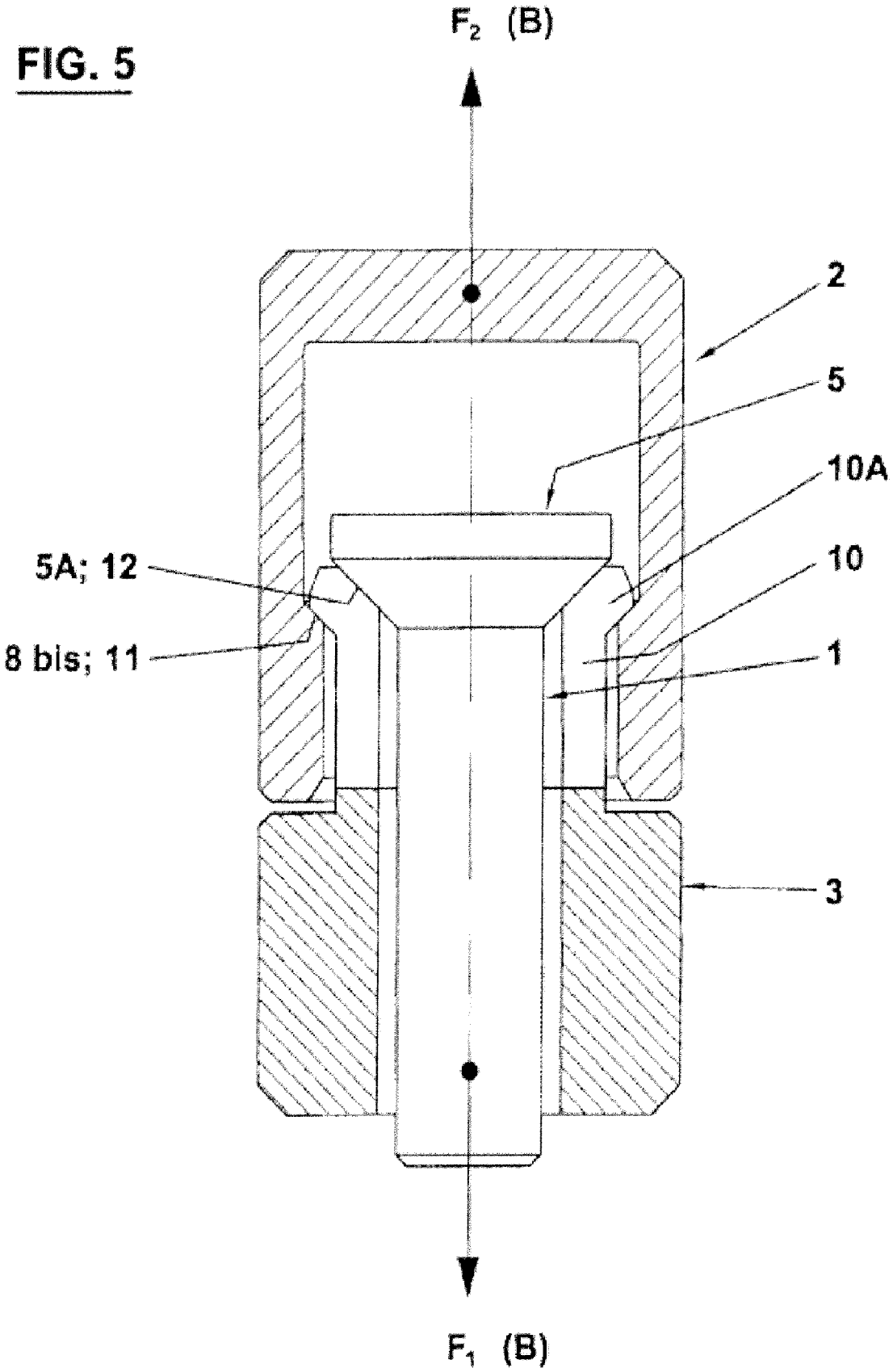
FIG. 5 is a sectional view in analogy to that of FIG. 1, illustrating a particular characteristic of the safety.

When a traction is applied to at least one necklace end, i.e. to parts 1 and/or 2 (see forces $F_2(B)$, $F_1(B)$ in FIG. 5, which illustrates the safety of the closure by self-locking action), head 5 of core 1 bears on corolla 10A of fingers 10 of part 3 (i.e. in this embodiment, at least part of the frustoconical surface 5A bears on surface 12). This causes the displacement of part 3 until at least part of surface 11 of corolla 10A of fingers 10 in turn bears on ramp 8bis of female part 2. Thus, any outward movement of core 1, i.e. in the direction of force $F_1(B)$ becomes impossible. In other words, the snap means are neutralized. With core 1 locked in this position, the clasp remains closed.

Figure 6:
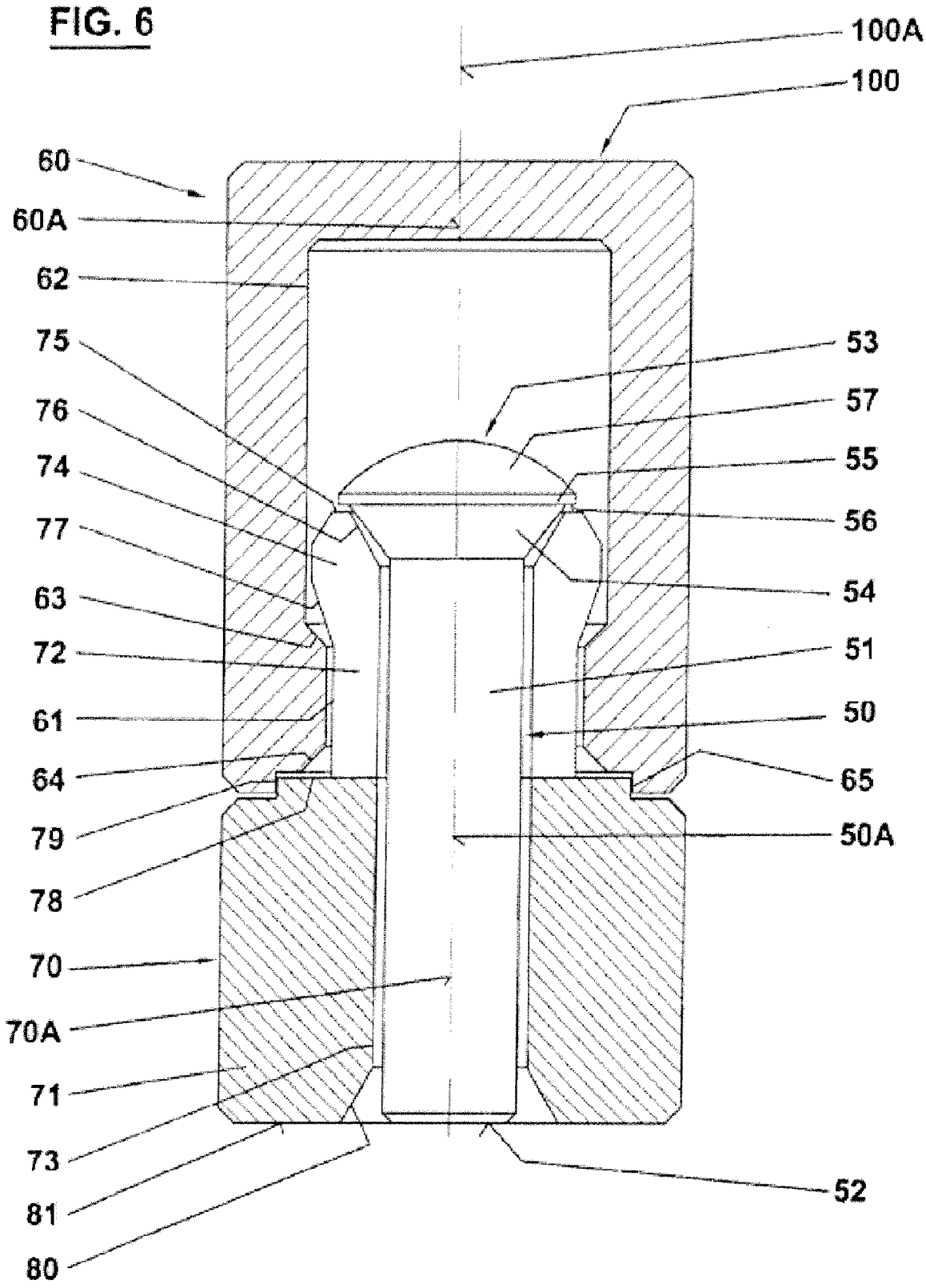
FIG. 6 is an axial section of the device according to a second embodiment in the closed condition, and FIGS. 7A, 7B; 8A, 8B show exemplary uses of the device.

FIG. 6 is an axial section in analogy to FIG. 1 of the device in the closed state, however according to a second embodiment designated by the general reference 100, with axis 100A. This device comprises an auxiliary element or core 50 with axis 50A, a female part 60 with axis 60A and a male part 70 with axis 70A. In this state, the axes of this element and of these parts coincide with each other and with axis 100A of the device.

Core 50 is formed of a cylindrical stem 51 having a lower surface 52 and, on the opposite side, a head 53 composed of a frustoconical portion 54 whose large diameter is heightened by a basis that is dimensioned so as to form an abutment 56 (whose function will be discussed below) together with frustoconical surface 54, whereas end portion 57 is convex.

Female part 60 is a preferably cylindrical cap that is destined to be connected to one end of a necklace or to a pendant, for example. An inner recess results from a cylindrical bore 61 whose diameter is defined so as to be able to form a guide for male part 70 (see below), this bore 61 opening onto a cylindrical bore 62, whose diameter is larger than the diameter of bore 61, via a frustoconical ramp 63. The lower side of bore 61 opens toward the exterior via a ramp 64 that is analogous to ramp 63.

Male part 70 is in the form of a two-part collet or sleeve 71, 72 having an inner bore 73 that extends from side to side and opens onto the exterior via flanks 76 (on the upper side) and a milling 80 (on the lower side). Upper part 72 connects to lower part 71 and forms a shoulder 78 with the latter. The upper part of the collet has at least two longitudinal slits (not referenced here) which, in the present example, terminate at the height of shoulder 78. The planes of symmetry (not shown) of each one of the slits comprise axis 70A, so as to form at least two fingers that are dimensioned so as to be elastically deformable. As in the first embodiment, the number of slits and therefore of fingers is four (and here also, the same reference 72 is being used to designate the fingers). The ends of fingers 72 open to form a corolla 74 having internal and external frustoconical surfaces 76 and 77, respectively, and an upper crown 75.

Core 50 extends inside male part 70 and on its upper side projects therefrom by its base 55, 57. Here, lower surface 52 of stem 51 is flush with lower surface 81 of male part 70. In contrast to the first embodiment, the slopes of frustoconical portions 76 and 77 of corolla 74, as well as those of frustoconical portions 54 (head) and 63 (ramp) are not uniform.

The (non-referenced) surfaces of female and male parts 60 and 70, respectively, located opposite each other have complementary shoulders 65; 79, the parts 60; 70 thus engaging in one another with a sliding fit.

The operation of the clasp during its opening and closure is equivalent to that described with reference to the first embodiment. It is therefore unnecessary to reconsider it in detail, except to mention the few particulars brought about by the differences in configuration.

Thus, abutment 56 of head 53, adapted to bear on crown 75 of corolla 74, has the effect of preventing that fingers 72 of male part 70 may open when the clasp is open. Such an opening might come about if an involuntary traction were applied to the end of the necklace (the heavier the necklace, the smaller a traction being sufficient), thereby pulling the head—in the absence of this safety provided by abutment 56—into the interior of the fingers between which it would subsequently remain caught. Moreover, this safety allows to provide more resilient fingers and thus to improve the comfort of use without sacrificing the closure safety.

This abutment 56 also facilitates the introduction of male part 70 into female part 60 as it limits the opening of the collet, i.e. of the fingers.

The rounded shape of head 53 facilitates its introduction in female part 60.

The difference in the opening angles of frustoconical parts 54 of head 53 and 76 of fingers 72 allow avoiding a possible build-up of dust particles that might practically "stick" these two elements 53, 72 and thereby make an opening difficult or even impossible.

The difference in the opening angles of frustoconical parts 77 of fingers 72 and of ramp 63 facilitates the contraction of fingers 72 during opening.

Shoulders 65; 79 prevent possible lateral twisting of the male and female parts and consequently any deformation and potentially resulting degradation of fingers 10; 72.

Finally, milling 80 at the entrance of bore 73 provides a larger space for the connection of the end of a bracelet, necklace, or other object to stem 51 in this area.

Figure 7A:
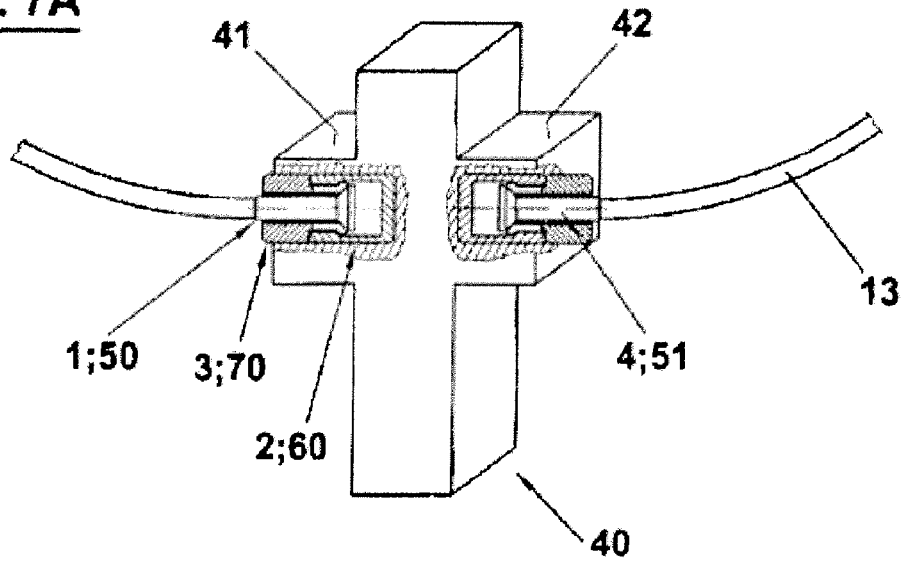
Figure 7B:
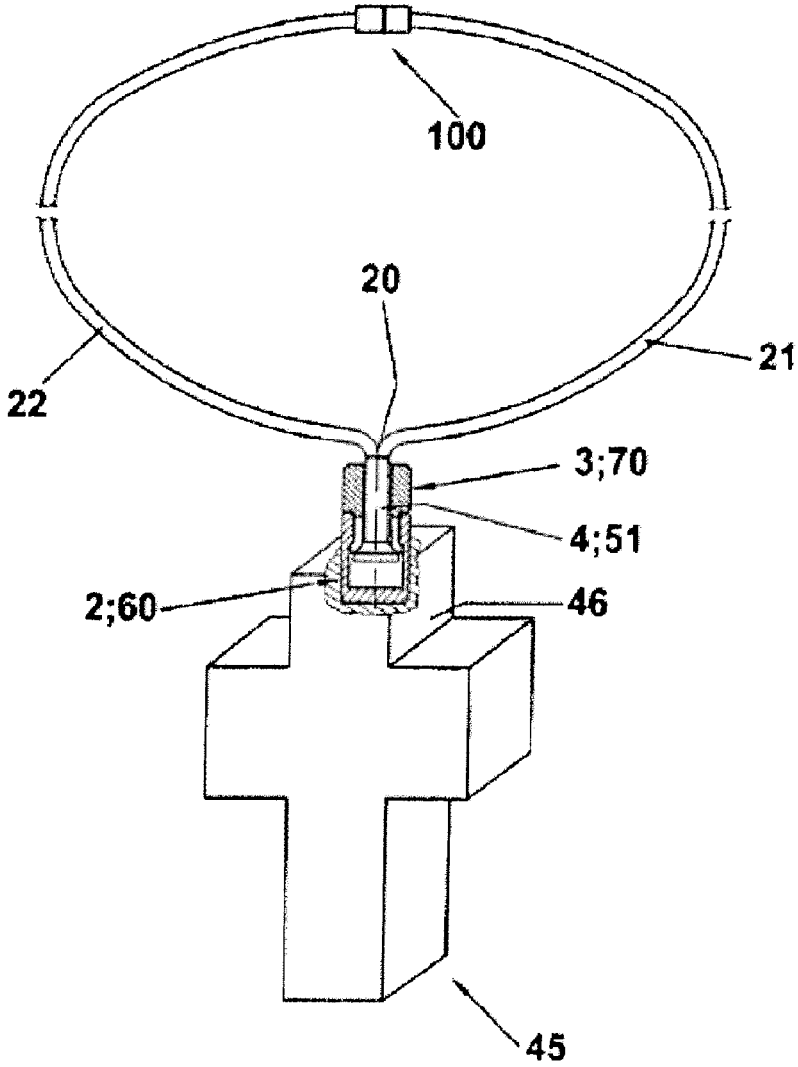

FIGS. 7A and 7B show the possibility of using the clasps for fastening jewels or other interchangeable objects to a chain. A cross 40 has been chosen in this example as it illustrates an original way of fastening a classic object to a chain or a wire. In the application according to FIG. 7A, female parts 2; 60 of two clasps have been set in respective holes made in each of the two horizontal arms 41, 42 of the cross. Each one of cores 1; 50 is fastened to one of the two ends of a wire 13 or a fine chain. In FIG. 7B, the female element 2; 60 of a single clasp is set in the upper part 46 of the vertical arm of a cross 45. Stem 4; 51 of core 1; 50 is connected to the ends of two necklace portions 21, 22, e.g. set in an orifice 20, the other ends of these necklace portions being connected to a clasp according to one or another of the possible embodiments, e.g. a clasp 100. If the user wants to change jewels, he or she only needs to open the clasp(s) and to attach e.g. a stone or a fantasy object that is also provided with one or two female clasp parts 2; 60.

Figure 8A:
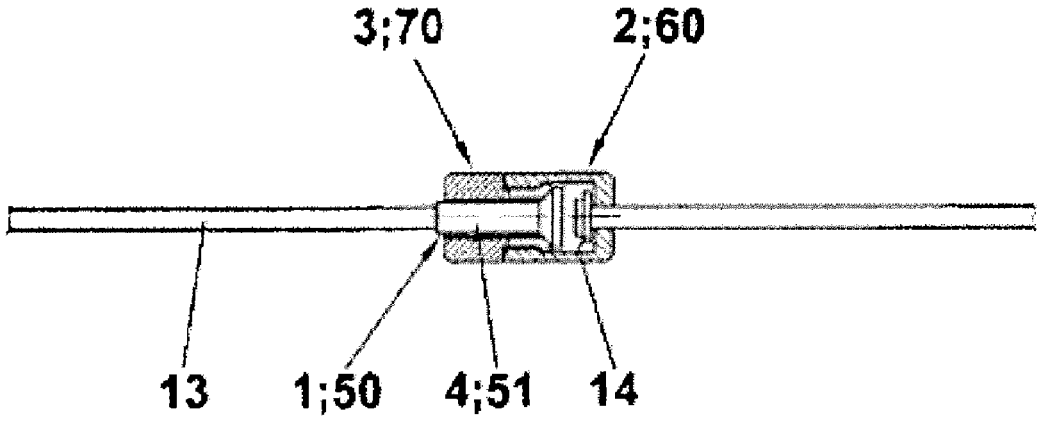

FIG. 8A shows the attachment of a clasp to a wire that is sometimes used to manufacture a necklace. A wire 13 (using the same reference as that which designates the wire in FIG. 7A), at one end of which a retaining device 14 is mounted, is fastened to female part 2; 60 that is provided with a passage (not referenced). Device 14 may also be fastened to the latter. The other end of the wire is connected to the stem of core 1; 50, e.g. set in an orifice 15 that is provided in the latter. The wire may be made of Nylon, of steel, or of another material of sufficient strength for this purpose. A cable can also be used. The connection between the wire and the stem of the core can be achieved with or without an intermediate member, e.g. by setting, driving in, cementing, welding, or screwing.

Figure 8B:
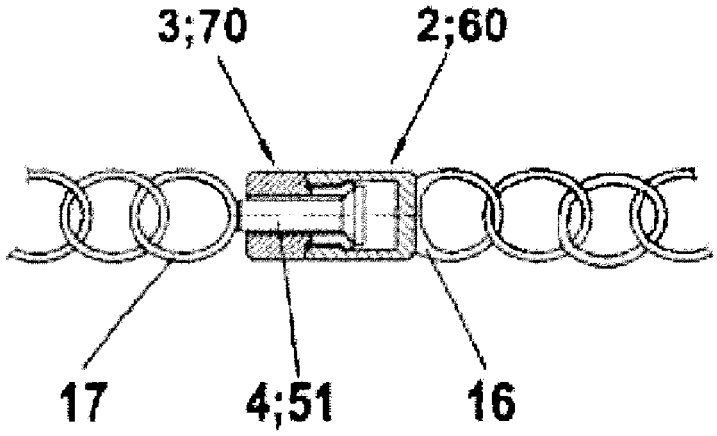

FIG. 8B shows the attachment of the clasp to a chain. Conventional rings 16 and 17 are welded onto female part 2; 60 and stem 1; 50, respectively.

Especially the external general shape of the clasp is advantageously cylindrical while it is understood that any other shape is conceivable, e.g. a prismatic one.

The clasp can be made from any adequate material such as gold, platinum, palladium, silver, stainless steel, aluminum, brass, while it is observed that a material having good elastic qualities will be chosen for the manufacture of fingers 10; 72.

The embodiments described above illustrate some of the numerous possible applications of the invention by way of examples. They are by no means limiting.

The invention claimed is:

1. A self-locking connecting device, particularly for jewelry and clockmaking, comprising:

a female part;

a male part, wherein at least one of the female part and the male part is connected to a necklace end, a link, or an object to be retained, wherein a female part axis and a male part axis coincide in a closed state of the device and wherein each of the female part and the male part include complementary snap elements configured to insert into one another and automatically be retained; and an auxiliary element including a stem, a head configured to neutralize the complementary snap elements in the closed state and to cause the device to be locked when a traction force is applied to the stem to ensure the safety and reliability of the connection, elements configured to cooperate with the complementary snap elements, in that said male part is snapped into the female part, and an auxiliary element axis, wherein the auxiliary element is arranged in the male part such that the male part axis and the auxiliary element axis coincide and wherein a locking element is formed of at least two elastic fingers having an end portion configured to be inserted through a bore into a recess of the female part to snap onto the female part, wherein the bore and the recess are rejoined by a frustoconical ramp, wherein the head includes:

a base, and a frustoconical portion that cooperates with the end portion and connects the base to the stem, wherein the frustoconical portion continuously extends at a constant angle from the base to the stem and a diameter of the stem is substantially constant, and wherein the end portion is configured to bear on the frustoconical ramp inside the recess, so that the male part can be disengaged from the female part together with the auxiliary element by applying opposed traction forces upon at least one of the male part, the female part and the auxiliary element.

2. The self-locking connecting device of claim 1, wherein the end portion is locked between the frustoconical ramp and the head when a traction force is applied to the stem.

3. The self-locking connecting device of claim 1, wherein the base comprises a cylindrical base.

4. The self-locking connecting device of claim 1, wherein the female part and the stem are provided with elements configured to connect to a link or element.

5. The self-locking connecting device of claim 1, wherein the end portion is in the shape of a corolla having frustoconical internal and external surfaces.

6. The self-locking connecting device of claim 5, wherein the frustoconical portion partly faces the frustoconical internal surface of the corolla and the frustoconical external surface of the corolla partly faces a ramp of the female part.

7. The self-locking connecting device of claim 5, wherein the base includes a cylindrical portion and a rounded end portion, the rounded end portion including an abutment configured to bear on an upper surface of the corolla.

8. The self-locking connecting device of claim 7, further comprising a ramp, wherein each of the at least two elastic fingers are configured to be introduced into the bore by the ramp and by the rounded end portion.

9. The self-locking connecting device of claim 1, wherein the stem is cylindrically shaped.

* * * * *